US005765241A

United States Patent [19]

Macdonald

[11] Patent Number: 5,765,241

[45] Date of Patent: Jun. 16, 1998

[54] FITTED SHEET FOR A MATTRESS, AND METHOD OF MAKING IT

[76] Inventor: Robert Macdonald, R.R. #1, Perth, Ontario, Canada, K7H 3C3

[21] Appl. No.: 687,120

[22] Filed: Jul. 24, 1996

Related U.S. Application Data

[63] Continuation-in-part of Ser. No. 598,824, Feb. 2, 1996, abandoned, which is a continuation-in-part of Ser. No. 276,963, Jul. 19, 1994, abandoned.

[30] Foreign Application Priority Data

Jul. 22, 1993 [CA] Canada ..... 2101108

[51] Int. Cl.[6] ..... A47G 9/02

[52] U.S. Cl. ..... 5/497; 5/495; 112/475.08

[58] Field of Search ..... 5/497, 495, 482, 5/499; 112/475.08, 2.1

[56] References Cited

U.S. PATENT DOCUMENTS

| | | | |
|---|---|---|---|
| 2,799,870 | 7/1957 | Sullivan . | |
| 3,380,086 | 4/1968 | McCurry . | |
| 3,956,782 | 5/1976 | Morrison . | |
| 4,045,831 | 9/1977 | Clark . | |
| 4,642,826 | 2/1987 | Bassetti | 5/497 |
| 4,723,331 | 2/1988 | Weiss | 5/497 |
| 4,912,790 | 4/1990 | Macdonald | 5/497 |
| 5,008,966 | 4/1991 | Lepow | 5/497 |
| 5,042,098 | 8/1991 | Stultz | 5/497 |
| 5,142,718 | 9/1992 | Anderson et al. | 5/497 |
| 5,325,555 | 7/1994 | Whitley | 5/497 |
| 5,603,132 | 2/1997 | Zafiroglu | 5/497 |

FOREIGN PATENT DOCUMENTS

| | | |
|---|---|---|
| 1168565 | 10/1969 | United Kingdom . |
| 1218393 | 1/1971 | United Kingdom . |
| 1452120 | 10/1976 | United Kingdom . |
| 2167457 | 5/1986 | United Kingdom . |

*Primary Examiner*—Alexander Grosz
*Attorney, Agent, or Firm*—Pearne, Gordon, McCoy and Granger LLP

[57] ABSTRACT

A sheet is provided for dressing a mattress. The sheet may be formed from a tube of knit fabric having spaced apart ends closed by end seams normal to the longitudinal axis of the tube. The tube is longitudinally open, from end to end, to provide an opening for application of the sheet to a mattress.

21 Claims, 4 Drawing Sheets

FITTED SHEET FOR A MATTRESS, AND METHOD OF MAKING IT

The present application is a continuation-in-part of U.S. application Ser. No. 08/598,824 filed Feb. 2, 1996, now abandoned, which is a continuation-in-part of U.S. application Ser. No. 08/276,963 filed Jul. 19, 1994, abandoned.

The present invention relates to the field of bed linens. In particular, the present invention provides a novel fitted sheet for covering a mattress (known as a bottom sheet), and a novel fitted top sheet as well.

Traditionally, fitted bottom sheets as defined above have been manufactured by cutting a pattern in a textile fabric, said pattern comprising rectangular notches cut in the corners of a rectangular sheet dimensioned to fit a mattress. The pattern is then sewn by the application of a seam in each notched corner corresponding to the corner edge of a mattress and the application of a band of elastic around each corner at the bottom edge of the textile fabric. An alternative method of construction in which a corner seam is sewn with elastic along its length is disclosed in applicant's issued U.S. Pat. No. 4,912,790, dated Apr. 3, 1990. The form of construction shown in that patent has succeeded in removing one step from the manufacturing process by combining the application of elastic with the sewing of the corner seam. However, the manufacturing of fitted bottom sheet remains a fairly labour intensive process. Because of the individual cutting of each corner and the individual application of elastic in each corner it has been infeasible to automate the manufacture of fitted bed sheets.

U.S. Pat. No. 3,380,086 issued to McCurry discloses a sheet based on a rectangular blank with folded side margins and glued along the transverse ends for a bassinet made in disposable non-woven fabric. While this is suited to automated manufacture, the design is not satisfactory as a fitted sheet. This prior art design fits very loosely having projecting ears of unfilled fabric at the corners and gaping marginal portions underneath the mattress. A bassinet has a light weight mattress which can be lifted and eased into such a sheet. Further the design is for newborn infants and will not be placed under the stresses of normal hospital use. Such a sheet on a full sized hospital mattress which lifts would quickly disengage. In addition, the loose fit would allow the sheet to wrinkle and move under the patient causing serious discomfort and problems to patients confined for long periods.

The present invention provides a fitted bed sheet which may be manufactured entirely by an automated process.

In one broad aspect, the present invention relates to a method of manufacturing a fitted bed sheet comprising the steps of: (i) cutting a blank of textile fabric in a rectangular shape, having a width substantially equal to the width of a selected mattress, plus about two or three times the depth thereof, and a length substantially equal to the length of said selected mattress, plus from about one-half to one times the depth thereof; (ii) folding said blank lengthwise whereby side margins corresponding to the depth of a said mattress are folded over and onto said blank; and (iii) sewing a seam at each end of said blank to sew the end edges of each said margin to the end edge of the blank over which it is folded, thereby to provide a fitted bed sheet.

In another broad aspect, the present invention relates to a fitted bed sheet for a bed including a main body portion dimensioned to be substantially congruent with the upper surface of a selected mattress, side margin portions extending from the side edges of said main body portion about one and a half times the depth of a said selected mattress, and head and foot portions extending from the end edges of said main body portion about one-half the depth of said selected mattress; said side margin portions being sewn, at their end edges to the adjacent end edges of said head and foot portion to form corner seams along the end edges of said head and foot portions.

In a further embodiment, the present invention provides a fitted sheet for a mattress, the sheet being made from a knitted fabric. That is, each of the sheets discussed above, both prior art, and this invention, utilizes a woven fabric in the manufacture of a fitted sheet. Knitted fabric, which is quite inexpensive, and soft to the touch, is also useful for the manufacture of fitted sheets, but has traditionally required the use of more complex patterns, and more hand sewing. An example of a prior art pattern for a knitted fabric is shown in FIG. 5.

The knit fabric, which has a two-way stretch, is supplied in a tubular form, the tube having an axial direction indicated by arrow 1. The corners, in a conventional pattern 4, are cut along one end of the tube and the tube slit along the side edge 5 between the corners. The corners are cut as a wide bevel, with a square notch 6 in the middle thereof, as shown in FIG. 5, and the tube 4 is cut at the level of the corners. Conventionally, then, the tube is unfolded, and each corner brought together and hand sewn on a machine, from the vertex 2 of each notch to the edge 3 of the bevel. This bevel and notch pattern creates a small pouch-type of structure at each end of the sheet, which is required in a knitted fitted sheet, to prevent the ends of the sheet, which will exhibit stretch, from creeping up and over the end of a mattress. However, such a problem still exists for knitted sheets used on hospital beds, because the mattress of a hospital bed can be raised up at an angle. That is, when the end of a mattress is lifted, there will be a tendency for the fitted sheet, if it is at all stretched, to form a bridge between the ends of the mattress. This makes it easy for the end of the conventional knit sheet to slip over the end of the mattress.

In view of the foregoing, it will be appreciated that knit fabrics are advantageous for use in making fitted sheets because of their low cost, and the attractive and comfortable fit achieved through the stretch characteristics of the fabric. However, to date the disadvantages associated with knit sheets, namely the high cost of hand labour to finish each corner thereof, and the tendency of the sheet to creep up and over the end of a hospital bed mattress, have tended to outweigh the advantages, such that there is only minimal usage of knit fabric fitted sheets in hospitals. Moreover, it will be understood that hospitals are a major market for sheets of any kind, since each bed in a hospital accounts for two or three sheets per year, on average.

Therefore, in another broad aspect, the present invention relates to a fitted bed sheet for use with a substantially rectangular mattress having a width W, a length L, and a depth D, said sheet being composed of a stretchable knitted fabric, said sheet, in a relaxed state comprising a substantially rectangular main body panel defining an upper surface of said sheet, and a pair of congruent side panels extending from said main body panel, and folded under same, said side panels and main body panels being sewn together along the end edges thereof.

In another broad aspect, then, the present invention relates to a method of manufacturing a fitted sheet for a mattress comprising the steps of: (i) providing a tube of knit fabric; (ii) slitting said tube lengthwise, and finishing the slit edges thereof, to provide a length of fabric with finished edges; (iii) folding the tube to substantially abut the slit and finished edges along the center line of the length of fabric;

and (iv) substantially simultaneously cutting and sewing across the fabric, transverse to the center line thereof at selected intervals to form sheets of lengths substantially corresponding to said intervals.

In another broad aspect, the present invention relates to a sheet for dressing a mattress, said sheet being formed from a tube of knit fabric having spaced apart ends closed by end seams normal to the longitudinal axis of said tube, said tube being longitudinally open, from end to end, to provide an opening for application of said sheet to a mattress.

It is an advantage of the present invention that the fitted sheet of knit fabric is able to fit the intended mattress tightly, while fully covering the upper surface and exposed sides. As a result, no undesirable wrinkling or movement of the sheet in use is encountered. An additional advantage of the improved fit is the economical use of less fabric than in prior art designs. Although the sheet does not describe a three dimensional volume, the stretch of the fabric accommodates the mattress as dressed with a closely conforming covering. Other prior art two dimensional designs leave undesirable ears, or unfilled fabric projections in the corner areas.

Further, the flexibility offered by the stretch fabric enables a single sheet to accommodate a variety of mattress lengths as are frequently encountered in institutional use.

In drawings that illustrate the present invention by way of example:

Figure 5A:
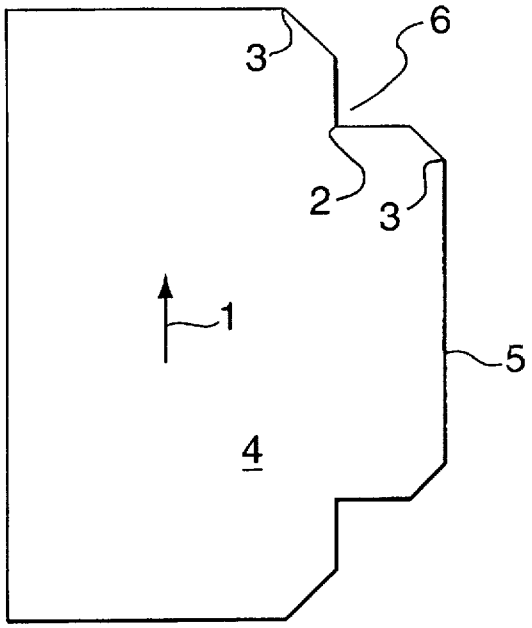
FIG. 5a PRIOR ART
Figure 5B:
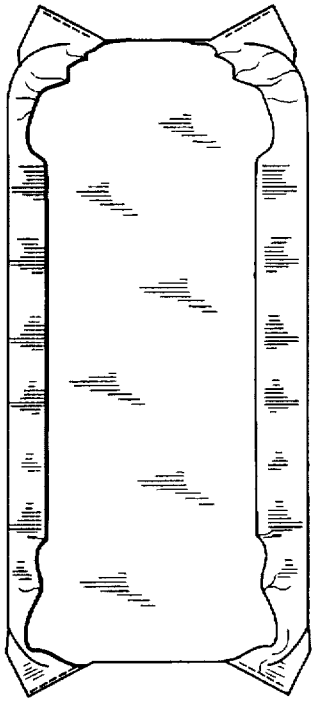
FIG. 5b PRIOR ART
Figure 6:
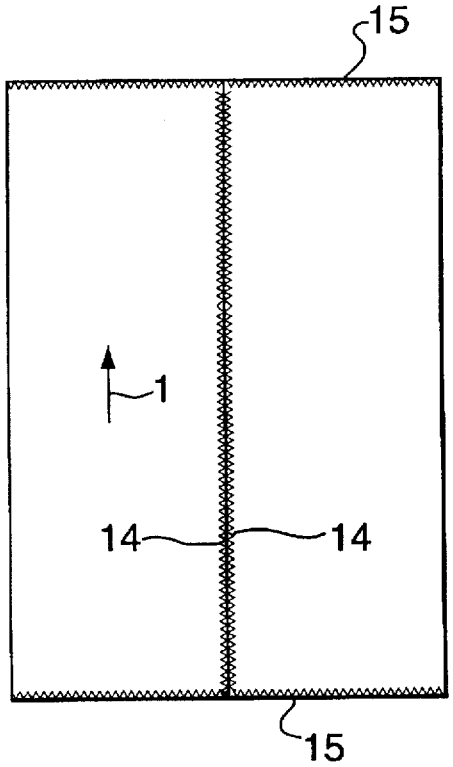
Figure 7:
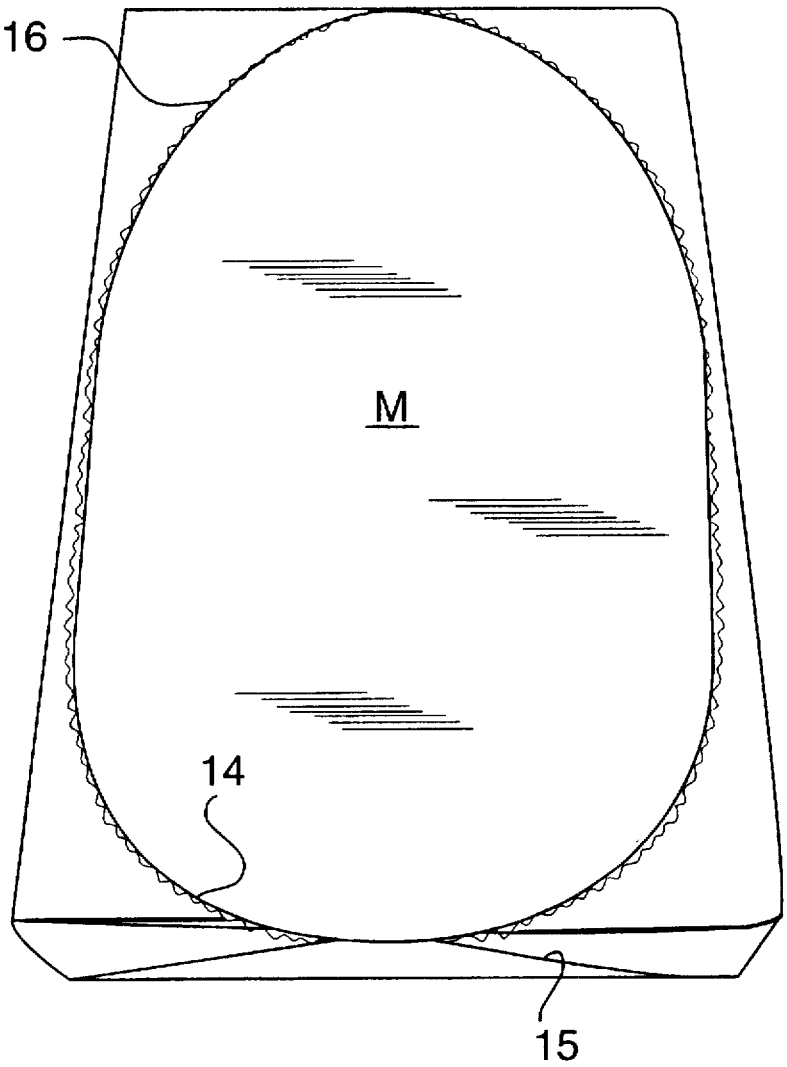

FIG. 5*a* is a plan view of a typical prior art pattern for use in making fitted sheets from knit fabric;

FIG. 5*b* is a view of the underside of the prior art product of McCurry, referred to above;

FIG. 6 is a plan view of a fitted sheet made from knit fabric according to another embodiment of the present invention; and FIG. 7 is an isometric view of the fitted sheet of knit fabric in use on a mattress illustrated from the underside of the mattress.

Figure 1:
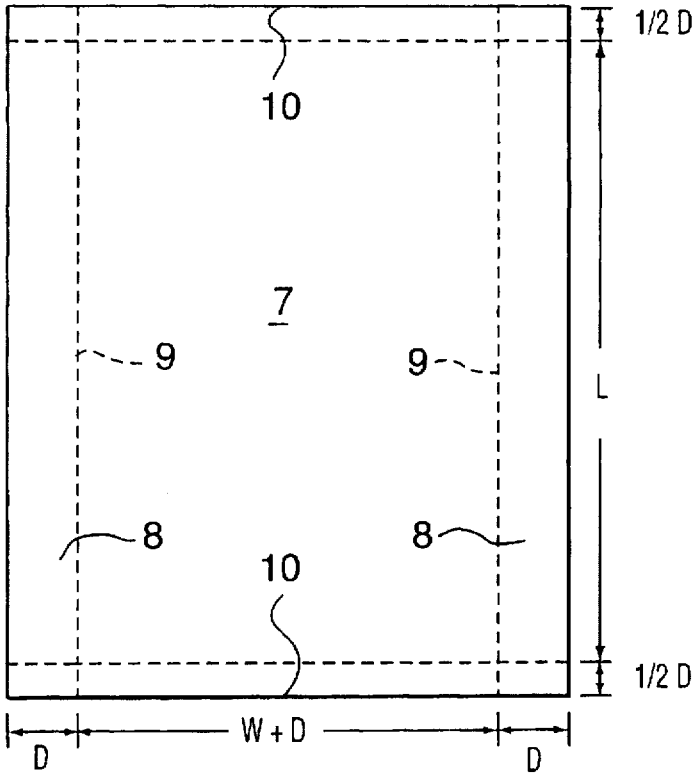
FIG. 1 is a plan view of a blank for a fitted bottom sheet according to one embodiment of the present invention.

Referring now to the drawings, a fitted sheet according to the present invention is constructed utilizing a blank 7, shown in FIG. 1, of textile material substantially equal in width W to the width of a selected mattress, plus about three times the depth D of the mattress. The length of the blank, on the other hand, is substantially equal to the length L of the selected mattress, plus about from one-half to one times the depth, preferably one times the depth, of the mattress. The side margins 8 of the blank, corresponding to the side surfaces of the mattress, and equal in width to the depth of same are folded over along longitudinal lines 9 onto the blank along their entire length. A finishing seam is then sewed along each end 10 of the blank (corresponding to W in FIG. 1), whereby the folded over margins are sewn at their end edges to the top and bottom edges of the blank to form pockets on each side of the blank extending the length of the sheet. The sheet is then folded and packaged for consumer use. The consumer then turns the pockets inside out, to put the sewn seams on the inside, and fits the sheet over a mattress.

It has been found by the applicant that the provision of a blank that is longer than a selected mattress by from one-half to one times the depth thereof provides enough additional material in each corner of the mattress so that the pocket formed in each corner by sewing the folded over margin of same will fit over each corner. A greater length would be quite loose fitting in each corner, and a lesser length would not permit the sheet to fit over the lower corners of the mattress. It will be understood, moreover, that if desired for a particular application, such as a sheet to fit a smaller and more flexible crib mattress, elastic may be sewn along each end seam. This is not necessary in most applications, however.

Figure 4:
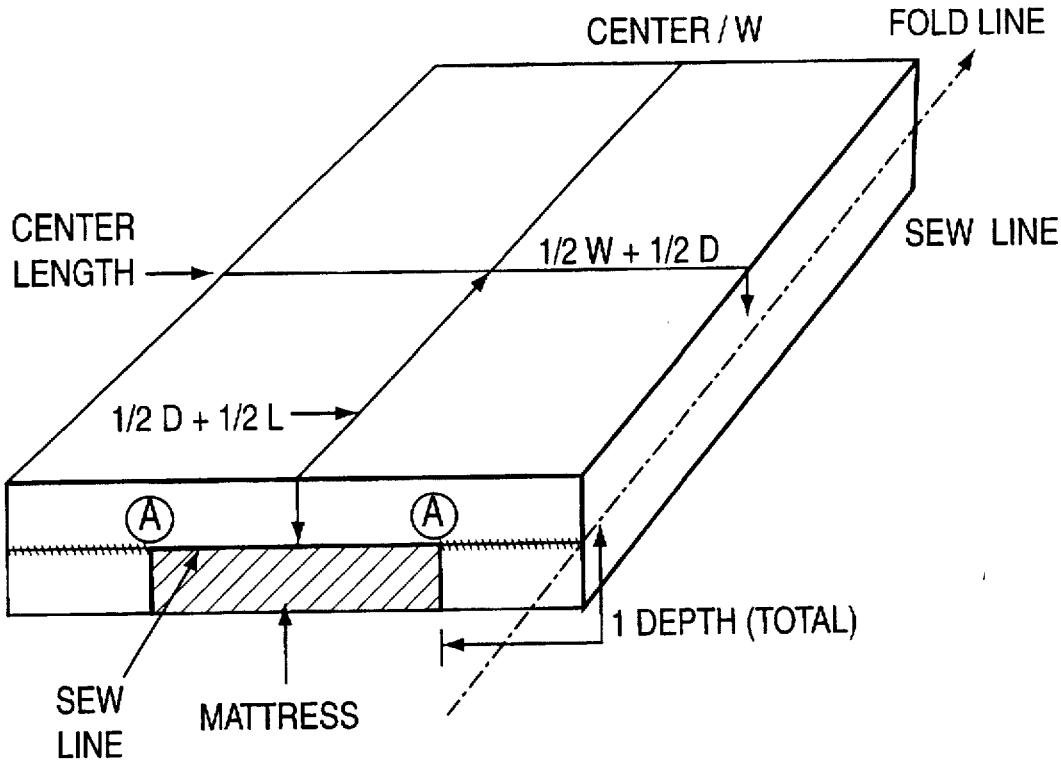
FIG. 4 is a schematic perspective view of a mattress dressed with the fitted sheets of FIGS. 1 and 2.

As will be observed from FIG. 4, which shows the position of the sew lines of a finished sheet when a bottom sheet according to the present invention is utilized to dress a mattress, there is minimum coverage of the end surfaces E of the mattress, but full coverage of the side surfaces S by side margins 8. This is not considered to be disadvantageous, however, because the head end of a mattress is usually against a surface such as a wall or a headboard, and the foot end of a mattress is usually covered by a top sheet.

Figure 2:
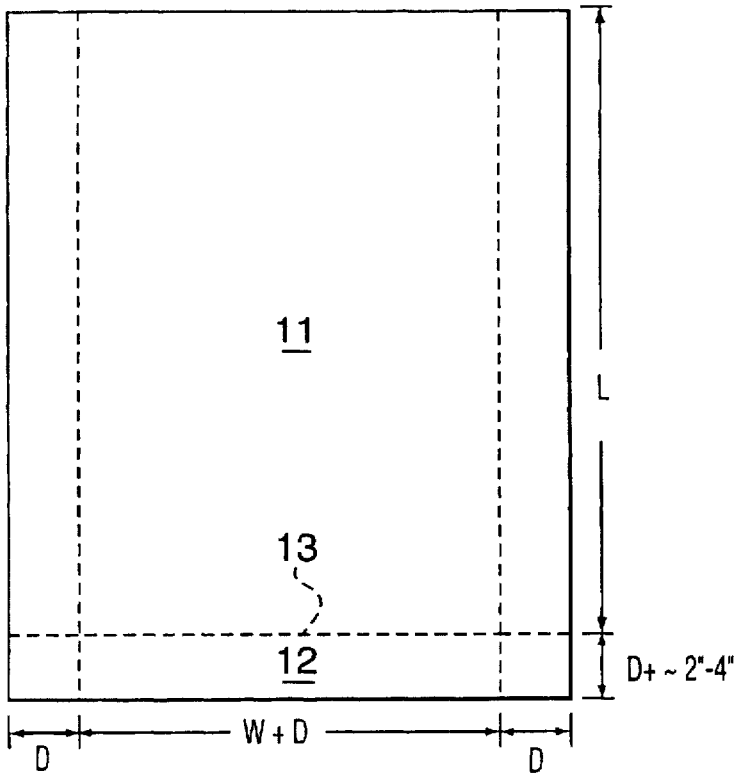
FIG. 2 is a plan view of a blank for a fitted top sheet according to the present invention.

As will be seen from FIG. 2, the present invention also provides a novel fitted top sheet. The top sheet according to the present invention is manufactured from a blank 11 equal in width to the width W of a mattress, plus three times the depth D of same. The blank is the length L of the selected mattress, plus the depth D, plus about two to four inches. The foot end 12 of the blank is folded over at a line 13 spaced from the end of the blank corresponding to the depth of the mattress plus the two to four inches. The side edges of the folded over portion are then sewn to the blank, to form a pocket. The resulting sheet is then folded and packaged. The consumer then inverts the pocket formed in the foot end of the sheet, for use.

Figure 3:
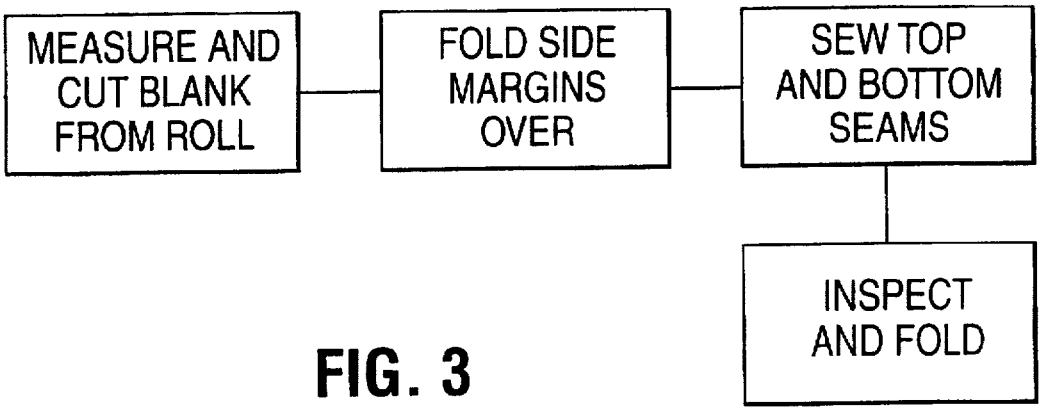
FIG. 3 is a schematic of a manufacturing method for a fitted bottom sheet according to the present invention.

Referring to FIG. 3, it will be understood that the fitted bottom sheet of the present invention lends itself, unlike previous fitted sheets, to machine manufacture, because it utilizes a rectangular blank of material, which straight line folds, and straight line sewing. Utilizing the present invention, blanks may be cut directly from a roll of fabric of correct width, and then finishing seams applied to the top and bottom of each blank, after folding over of the margins. The sheet requires no hand finishing, rotation on a work table or insertion of elastic.

FIG. 6 illustrates an embodiment of the present invention for use with knitted fabrics. Knitted fabric is produced in a tubular form, the tube extending in the direction of arrow 1. In the embodiment of the present invention for use with knitted fabrics, the tube is slit and finished on its edges 14 in a first step, and then folded back into its original tube configuration, with the finished edges meeting in the centre of the tube, as shown in FIG. 6. The ends 15 of the sheet are then cut and finished, in a single operation per end, to provide a finished product. The length of fabric between the ends of the sheet of FIG. 6 is not critical, since the knit fabric will stretch. The maximum length of fabric will, however, be the length of a selected mattress plus twice the depth. Any longer, and the sheet will not fit. The minimum length will depend on the stretch properties of the fabric being used, and selection of an appropriate length of fabric will be a matter of choice to one skilled in the art and schooled in the teachings of the present invention. However, the application has found that a length of fabric about equal to the length of the selected mattress to be dressed, plus up to about the depth thereof, is appropriate.

Moreover, while the applicant has found the best success with folding the sides of the fabric until they meet midway, leaving a small gap between the finished side edges of the knit fabric will not affect the performance of the sheet. The gap should not be greater than about half the width of the mattress to be dressed. Moreover, it will be understood that for hospital bed usage, the gap will preferably be minimal, or no gap at all will be provided. This assists in preventing any creep of the sheet over the top of the mattress.

As seen in FIG. 7, substantially the full upper surface of the mattress M will be covered by the sheet of the present invention. Distortion between lateral and longitudinal stretch permits the ends of the sheet to fully enclose the ends of the mattress and results in the oval shaped opening defined by the longitudinal edges.

Advantageously the edges 14 are bound to finish the raw cut fabric. A knit binding 16, particularly having a more limited stretch property than the fabric, may serve to constrict the opening and batter prevent disengagement in use. A binding of elastic material or overstitching may also be used.

Preferably the longitudinal edges 14 overlap slightly at the ends 15 of the sheet, which are finished with transverse seams. This serves to pull the sheet more tightly over the sides of the mattress, as well as providing a stronger construction.

The applicant has determined that a gap of about half the depth of the mattress between the side edges of the knitted fabric results in a knitted sheet that will not creep over the top edge of the end of a mattress. Moreover, such a gap will, with a knitted fabric having a normal degree of elongation, not creep up significantly more than half way up the end of the mattress. Such creep will, in any event be limited to a semi-circular area in the center of the mattress, along the lower edge of the ends. A sheet with no gap between the side edges will not creep up the ends of the mattress.

The total width of knit fabric for any selected mattress will be calculated substantially as for the other embodiment of the present invention. That is, the total width should be the width of the mattress, plus about thrice the depth. However, it will be clearly understood that much wider variance in width will be possible with embodiments of the present invention utilizing knit fabrics, because of the inherent stretchability of knit fabrics.

Clearly, a fit as described in the present invention is dependent on the stretch properties of the fabric. A preferred fabric has both longitudinal and lateral stretch Sleepknit® fabric manufactured by Med-I-Pant Inc. has proven to have appropriate stretch qualities. Under weight tension Sleep-Knit® demonstrates a lateral stretch of 88–135% and a longitudinal stretch of 22–31%. This compares to 1–6% lateral stretch and 0–1% longitudinal stretch for a standard woven fabric under the same weight tension conditions. With such stretch properties, the finished sheet of the present invention may have a width, in a relaxed condition, of 75–100% of the width of the mattress to be dressed while still providing full coverage. The length of the finished sheet, in a relaxed condition, will be approximately the length of the mattress to be dressed to about the length plus one times the depth of the mattress.

It is to be understood that the examples described above are not meant to limit the scope of the present invention. It is expected that numerous variants will be obvious to the person skilled in the field of bed sheet manufacture without any departure from the spirit of the invention. The appended claims, properly construed, form the only limitation upon the scope of the invention.

I claim:

1. A method of manufacturing a fitted sheet for a mattress comprising the steps of:

i) providing a tube of knit fabric;

ii) slitting said tube lengthwise, and finishing the slit edges thereof, to provide a length of fabric with finished edges;

iii) folding said length of fabric to substantially abut said finished edges thereof along the center line of said length of fabric; and iv) substantially simultaneously cutting and sewing across the fabric, transverse to the center line thereof at selected intervals to form substantially rectangular envelopes of lengths substantially corresponding to the said intervals.

2. A method as claimed in claim 1, wherein said slit edges of said tube of fabric are finished by overstitching.

3. A method as claimed in claim 2, wherein said finished edges overlap slightly.

4. A sheet for dressing a mattress, said sheet being a substantially rectangular envelope and being formed from a tube of knit fabric having spaced apart ends closed by end seams normal to the longitudinal axis of said tube, said envelope having a longitudinal opening therein, from end to end, to provide an opening for application of said sheet to a mattress.

5. A sheet as claimed in claim 4, wherein the longitudinal opening is substantially perpendicular to said end seams, and extends from about the mid-point of one end to about the mid-point of the opposite end.

6. A sheet for dressing a mattress as claimed in claim 5, wherein the edges of said opening are finished to prevent deterioration of said fabric.

7. A sheet for dressing a mattress as claimed in claim 6, wherein said edges of said opening are provided with seams, overstitching, binding, or elastic.

8. A sheet as claimed in claim 6, wherein the ends of said tube are spaced apart by a distance in the range of from about the length of a said selected mattress to about the length of said selected mattress plus about twice the thickness thereof.

9. A sheet as claimed in claim 8, wherein said edges overlap slightly.

10. A sheet as claimed in claim 8, wherein said edges substantially abut.

11. A sheet as claimed in claim 8, wherein said edges are spaced apart slightly, by a distance up to about half the thickness of a selected mattress.

12. A sheet as claimed in claim 8, wherein the relaxed flattened width of a said sheet has a size in the range of from about 75% of the width of a said selected mattress to about 100% of the width of a said selected mattress.

13. A sheet as claimed in claim 12, wherein the ends of said tube are spaced apart by about the length of a said selected mattress, plus the thickness thereof.

14. A sheet as claimed in claim 12, wherein the flattened width of a said tube has a size in the range of the width of a said selected mattress.

15. A sheet as claimed in claim 14, wherein the flattened width of a said sheet is about ⅚ the width of a said selected mattress.

16. A fitted sheet for a mattress comprising:

i) a substantially rectangular envelope of stretch knit fabric having a central portion and equal overlapping marginal portions with adjacent longitudinal edges, opposite ends of said marginal portions and said central portion being secured together by lines of transverse stitching;

ii) corner pockets defined by said transverse stitching for substantially enclosing the ends of said mattress; and iii) a central longitudinal opening between the edges of the marginal portions, said opening having a length substantially equal to the length of the mattress for admitting said mattress and for preventing disengagement therefrom;

said edges forming a substantially oval shaped opening in a stretched configuration in use on said mattress.

17. A fitted sheet for a mattress as claimed in claim 16, wherein the longitudinal edges are abutting.

18. A fitted sheet for a mattress as claimed in claim 16, wherein the longitudinal edges overlap.

19. A fitted sheet for a mattress as claimed in claim 16, wherein the longitudinal edges are spaced apart a distance up to the depth of said mattress.

20. A fitted sheet for a mattress as claim 16, wherein the longitudinal edges are finished with binding.

21. A fitted sheet for a mattress as claimed in claim 20, wherein the binding has more limited stretch properties than the knit fabric.

* * * * *

UNITED STATES PATENT AND TRADEMARK OFFICE

CERTIFICATE OF CORRECTION

PATENT NO. : 5,765,241

DATED : June 16, 1998

INVENTOR(S) : Robert Macdonald

It is certified that error appears in the above-identified patent and that said Letters Patent is hereby corrected as shown below:

Col. 4, line 36, "which" should be --with--.

Col. 4, line 60, "application" should be --applicant--.

Col. 5, line 15, "batter" should be --better--.

Col. 5, line 43, "stretch" should be --stretch.--.

Col. 6, line 55, claim 15, "sheet" should be --tube--.

Signed and Sealed this

Twenty-ninth Day of September, 1998

*Attest:*

*Attesting Officer*

Bruce Lehman

BRUCE LEHMAN

*Commissioner of Patents and Trademarks*